US009427956B2

(12) United States Patent
Nitta et al.

(10) Patent No.: US 9,427,956 B2
(45) Date of Patent: Aug. 30, 2016

(54) DRIVE METHOD AND DRIVE APPARATUS FOR INK JET HEAD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Noboru Nitta, Shizuoka (JP); Takashi Norigoe, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/492,271

(22) Filed: Sep. 22, 2014

(65) Prior Publication Data

US 2016/0082722 A1 Mar. 24, 2016

(51) Int. Cl.
*B41J 2/045* (2006.01)

(52) U.S. Cl.
CPC ..... *B41J 2/04541* (2013.01); *B41J 2/0459* (2013.01); *B41J 2/04573* (2013.01); *B41J 2/04581* (2013.01); *B41J 2/04588* (2013.01); *B41J 2/04591* (2013.01); *B41J 2/04598* (2013.01)

(58) Field of Classification Search
CPC ..... B41J 2/04541; B41J 2/04573; B41J 2/04581; B41J 2/04588
USPC ..... 347/9–11
See application file for complete search history.

(56) References Cited

U.S. PATENT DOCUMENTS

| | | | | |
|---|---|---|---|---|
| 6,106,092 | A | 8/2000 | Norigoe et al. | |
| 6,193,343 | B1 | 2/2001 | Norigoe et al. | |
| 7,452,042 | B2 | 11/2008 | Norigoe | |
| 7,661,785 | B2 | 2/2010 | Norigoe | |
| 7,802,864 | B2 | 9/2010 | Norigoe | |
| 8,752,925 | B2 | 6/2014 | Norigoe | |
| 2006/0187275 | A1 * | 8/2006 | Iriguchi | 347/71 |
| 2011/0279502 | A1 | 11/2011 | Kaneko et al. | |
| 2013/0063508 | A1 * | 3/2013 | Norigoe | B41J 2/04588 347/11 |

FOREIGN PATENT DOCUMENTS

| | | |
|---|---|---|
| JP | 2000-015803 | 1/2000 |
| JP | 2008-093950 | 4/2008 |
| JP | 2013-039768 | 2/2013 |
| JP | 2013-039769 | 2/2013 |
| JP | 2013-075509 | 4/2013 |

* cited by examiner

*Primary Examiner* — Jason Uhlenhake
(74) *Attorney, Agent, or Firm* — Amin, Turocy & Watson LLP

(57) ABSTRACT

In accordance with an embodiment, a drive method for an ink jet head comprising: a drive pulse, applying a first pulse for increasing and then restoring the volume of a pressure chamber and giving pressure vibration to the chamber in which ink are accommodated, and then a second pulse for reducing and then restoring the volume of the pressure chamber to an actuator arranged corresponding to the pressure chamber; wherein the second pulse is turned on at first point of time causing the pressure vibration amplitude at second point of time to be the same with that of generated by the first pulse when the first pulse is turned on, wherein the second point of time is the time when flow velocity of the ink nearby the nozzle inside the pressure chamber becomes 0 after the first point of time, and the second pulse is turned off at the second point of time.

12 Claims, 10 Drawing Sheets

DRIVE METHOD AND DRIVE APPARATUS FOR INK JET HEAD

FIELD

Embodiments described herein relate to a drive method and a drive apparatus for the ink jet head used in an ink jet printer and the like.

BACKGROUND

An ink jet head comprises a plurality of pressure chambers for accommodating ink, a plurality of piezoelectric actuators arranged corresponding to each of the pressure chambers and a nozzle plate arranged on one end of each of the pressure chambers. A plurality of nozzles, which are connected with the pressure chambers, respectively, are formed on the nozzle plates to eject ink drops. Each piezoelectric plate vibrates a corresponding pressure chamber across a vibration plate.

A drive apparatus for such an ink jet head applies a drive pulse signal to piezoelectric actuators. Vibration is generated in pressure chambers according to the drive pulse signal when the internal volume of the pressure chambers is changed to eject ink drops from nozzles connected with the pressure chambers.

However, the vibration generated in the pressure chambers remains in the pressure chambers after the ink drops are ejected out, which hinders the stable ejection of following ink drops.

DETAILED DESCRIPTION

In an embodiment, a drive method for an ink jet head comprises: as a drive pulse, applying a first pulse for increasing and then restoring the volume of a pressure chamber and giving pressure vibration to the chamber in which ink are accommodated and then a second pulse for reducing and then restoring the volume of the pressure chamber to an actuator arranged corresponding to the pressure chamber.

In the drive method, the second pulse is turned on at first point of time causing the pressure vibration amplitude at second point of time to be the same with that of generated by the first pulse when the first pulse is turned on, The second point of time is the time when flow velocity of the ink nearby the nozzle inside the pressure chamber becomes 0 after the first point of time, and the second pulse is turned off at the second point of time.

Embodiments of the drive method and the drive apparatus for an ink jet head provided herein are described below with reference to the accompanying drawings. First, the ink jet head 1 used in the embodiment is described with reference to FIG. 1-FIG. 3.

Figure 1:
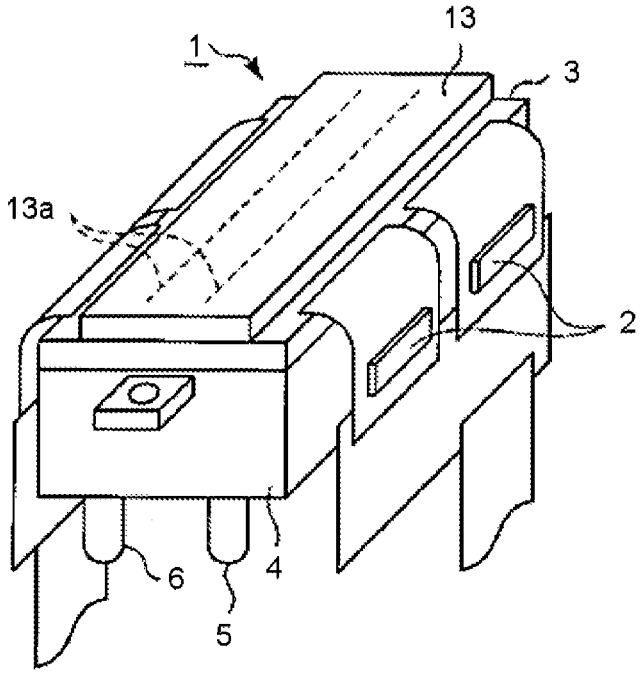
FIG. 1 is an oblique view of an ink jet head.
Figure 2:
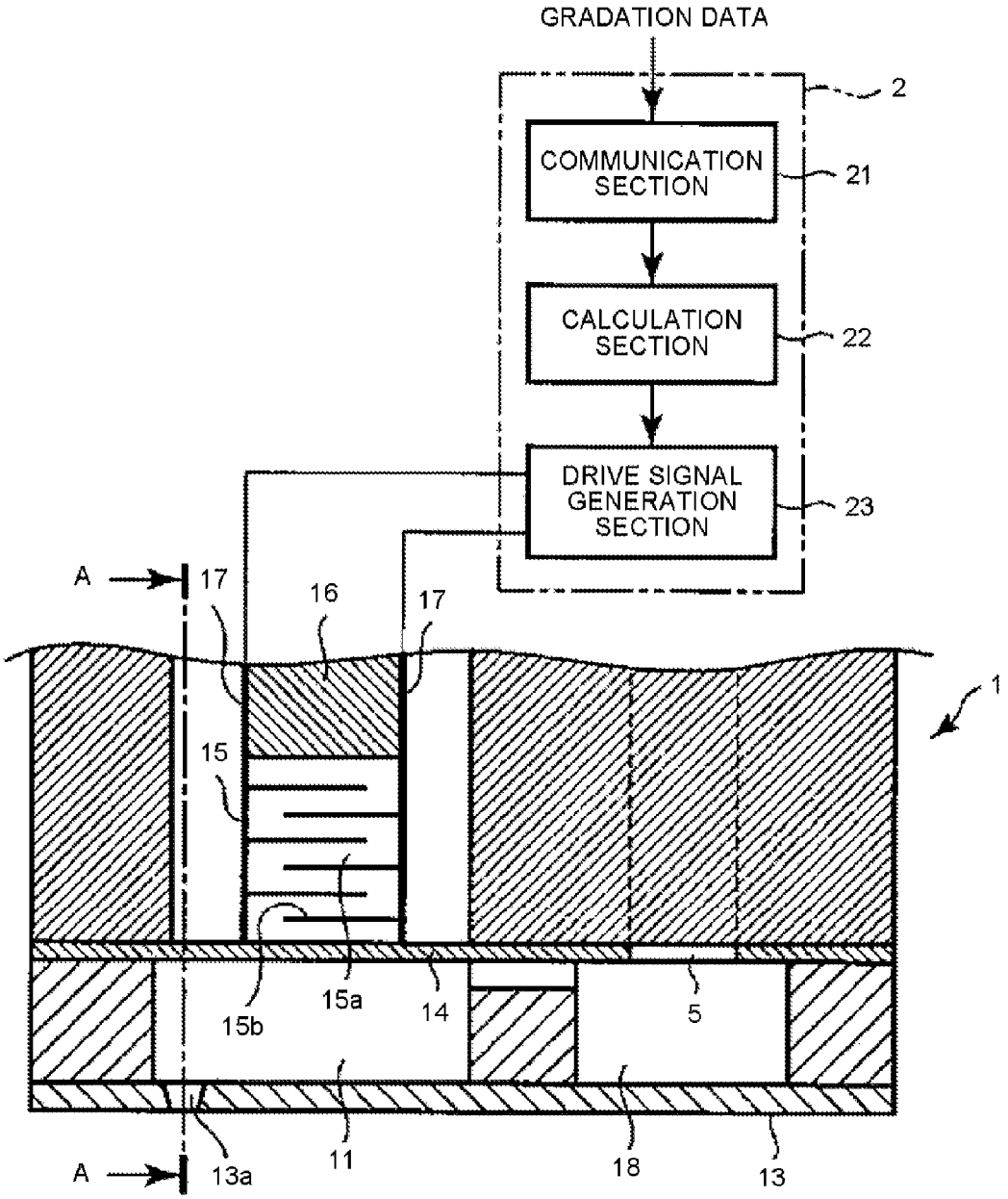
FIG. 2 is a configuration diagram illustrating main components of an ink jet head with a cross-section surface.
Figure 3:
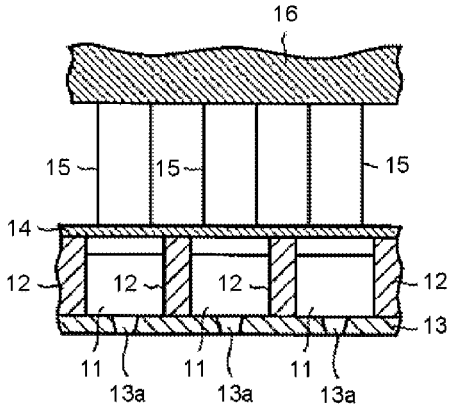
FIG. 3 is a cross-sectional view illustrating an ink jet head observed from the direction of the arrow A-A shown in FIG. 2.

FIG. 1 is an oblique view illustrating the ink jet head 1, FIG. 2 is a configuration diagram illustrating main components of the ink jet head 1 with a cross-section surface, and FIG. 3 is a cross-sectional view illustrating the ink jet head 1 observed from the direction of the arrow A-A shown in FIG. 2.

The ink jet head 1 comprises a drive device 2, a head substrate 3 and a manifold 4. The manifold 4 is equipped with an ink feed tube 5 and an ink discharging tube 6. The ink jet head 1 ejects the ink fed from an ink feeding unit (not shown) through the feed tube 5 out from each nozzle 13*a* according to a drive signal from the drive device 2. The part of the ink fed into the manifold 4 from the feed tube 5 which is not ejected out from each nozzle 13*a* is discharged from the discharging tube 6 to the ink feeder.

A plurality of parallel pressure chambers 11 are arranged in the head substrate 3 corresponding to the nozzles 13*a*, respectively. The bottom side (the bottom side in FIG. 2, the top side in FIG. 1) of each pressure chamber 11 is adhered with a nozzle plate 13 on which a plurality of nozzles 13*a* are bored. The pressure chambers 11 are separated from each other by partition walls 12 to accommodate ink separately. The nozzles 13*a* are bored on the nozzle plate 13 in columns (two columns in FIG. 1) along the longitudinal direction of the nozzle plate 13. From the inner side, that is, the side of the pressure chambers 11 to the surface (surface=bottom side in FIG. 2, and surface=top side in FIG. 1) serving as an ink ejecting side, each nozzle 13*a* is formed in a tapered shape.

In the ink jet head 1, a vibration plate 14 is adhered to the top face side of each pressure chamber 11, with whose top side stuck fast to one end of a plurality of piezoelectric members 15 arranged corresponding to the pressure chambers 11, respectively. The ink jet head 1 holds the other end of each piezoelectric member 15 with a holding member 16. Each piezoelectric member 15 is formed by laminating a plurality of piezoelectric layers 15*a* and electrode layers 15*b* alternatively. In the ink jet head 1, a pair of electrodes 17 are arranged in such a manner that each electrode layer 15*b* is sandwiched between the electrodes. The two electrodes 17 are electrically connected with the drive device 2.

A common liquid chamber 18 is formed in the head substrate 3 of the ink jet head 1. Ink is injected into the common liquid chamber 18 through the feed tube 5. The common liquid chamber 18 is connected with each pressure chamber 11 so that the injected ink is filled into each pressure chamber 11 and the nozzle 13*a* corresponding to the pressure chamber 11. By filling the pressure chambers 11 and the nozzles 13*a* with ink, an ink meniscus is formed in the nozzles 13*a*.

In the ink jet head 1 with a related structure, if a drive signal is applied from the drive device 2 to the piezoelectric member 15 through the electrodes 17, then the piezoelectric member 15 expands or contracts. With the expansion or contraction of the piezoelectric member 15, the vibration plate 14 is deformed such that vibration is given to the pressure chamber 11. Because of the vibration, the volume of the pressure chamber 11 changes, generating a pressure wave in the pressure chamber 11 to eject ink drops from the nozzle 13*a*. Here, the vibration plate 14 and the piezoelectric member 15 serve as an actuator which vibrates the pressure chamber 11. That is, as many actuators are arranged on the ink jet head 1 as the nozzles 13*a*.

Next, the drive device 2 is described. The drive device 2 comprises: a communication section 21, an operation section 22 and a drive signal generation section 23. The communication section 21 receives gradation data of an image to be printed from a host computer for controlling, for example, an ink jet printer. The operation section 22 calculates the number of drive pulse trains for each nozzle 13*a* based on the gradation data. The drive signal generation section 23 supplies a drive pulse signal to a piezoelectric member 15 corresponding to a nozzle 13*a*, the drive pulse signal having as many drive pulse trains as the number calculated by the operation section 22 for each nozzle 13*a*.

By applying the pulse voltage of the drive pulse signal to the piezoelectric member 15, ink drops, the number of which is equivalent to that of pulse trains, are ejected out from the nozzle 13*a* of the pressure chamber 11 corresponding to the piezoelectric member 15. An ink jet recorder consisting of the ink jet head 1 and the drive device 2 converts the number of the ink drops into a pixel unit and adjusts the concentration of pixels to implement gradation printing to print an image, that is, the ink jet recorder prints in a multi-drop manner.

Figure 4:
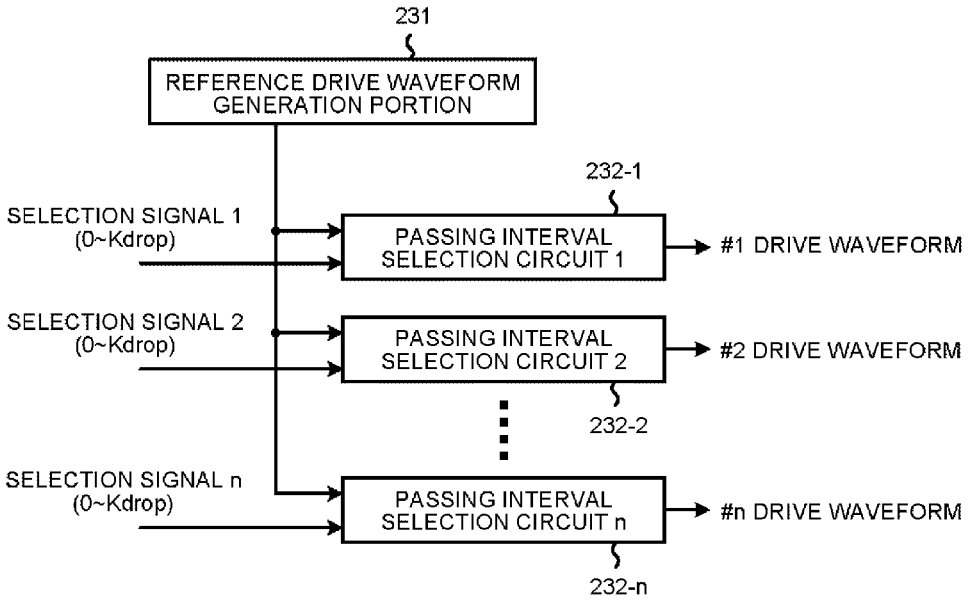
FIG. 4 is a block diagram illustrating the configuration of a drive signal generation section.

FIG. 4 is a block diagram illustrating the configuration of the drive signal generation section 23. The drive signal generation section 23 comprises a reference drive waveform generation portion 231 and passing range selection circuits 232-1 to 232-*n* for the nozzles 13*a*. The reference drive waveform generation portion 231 generates a drive pulse signal for the continuous ejecting, from the nozzles 13*a*, of the number of ink drops needed for the formation of pixels of a maximum gradation value G. In the embodiment, the drive pulse signal is referred to as a reference pulse signal. Each of the passing range selection circuits 232-1 to 232-*n* replaces the reference pulse signal with a drive pulse signal indicating a drop number 0-K selected by a selection signal and output the drive pulse signal.

Figure 5:
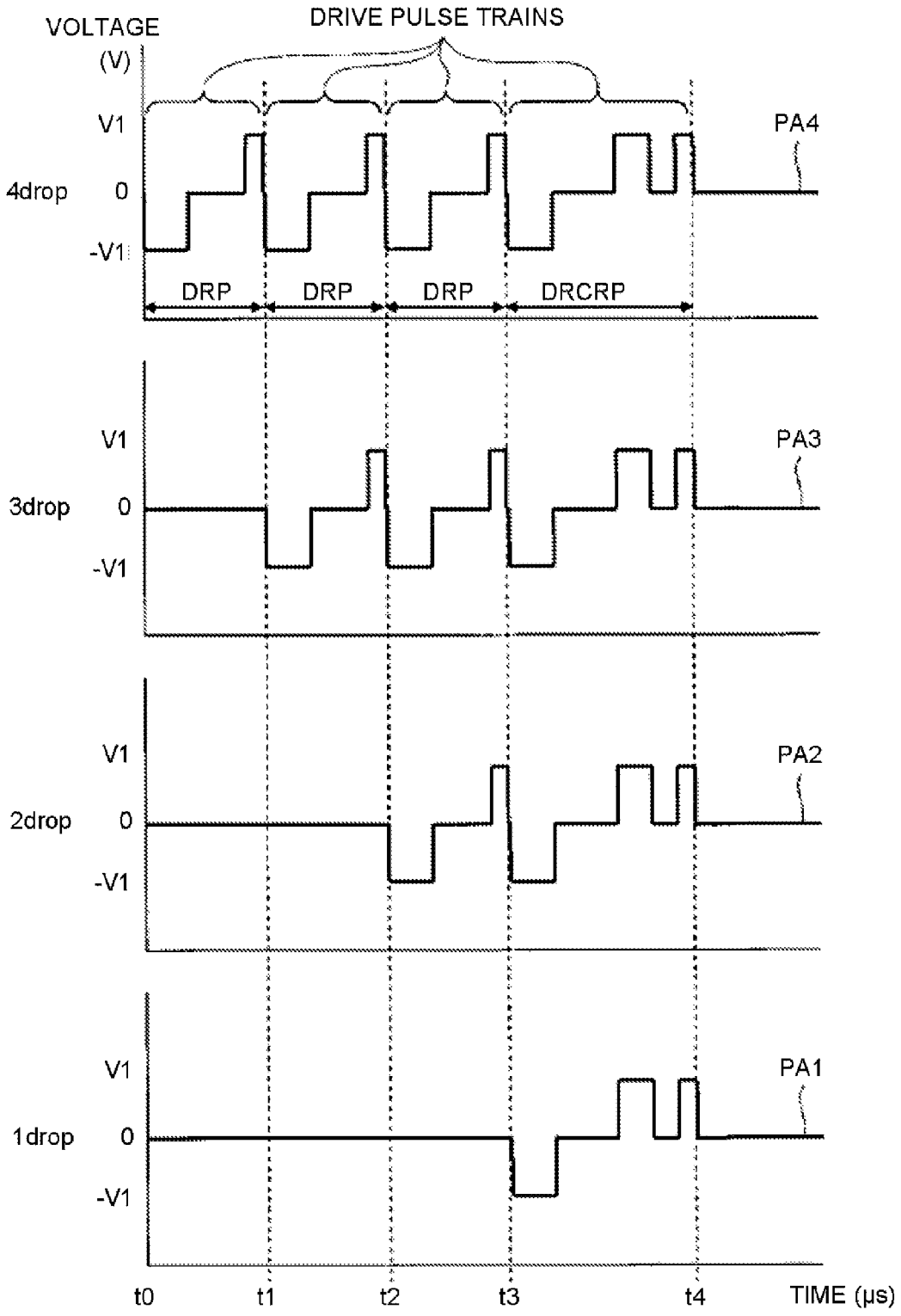
FIG. 5 is a timing chart illustrating an example of the waveform of a drive pulse signal output from a drive signal generation section.

FIG. 5 shows an example of waveforms of drive pulse signals PA4, PA3, PA2 and PA1 output from the passing range selection circuits 232-1 to 232-*n* when the maximum gradation value G is '4'. The drive pulse signal PA4 consists of the DRP waveform in the time range t0-t1, the DRP waveform in the time range t1-t2, the DRP waveform in the time range t2-t3 and the DRCRP waveform in the time range t3-t4. DRP waveform and DRCRP waveform are drive pulse trains, respectively. The drive pulse signal PA4 consisting of four drive pulse trains is the same as the reference pulse signal generated by the reference drive waveform generation portion 231.

When a selection signal indicating the selection on four drops is input to the passing range selection circuits 232-1 to 232-*n*, the passing range selection circuits 232-1 to 232-*n* select the time range t0-t4 of the reference pulse signal as a whole passing range, as a result, the drive pulse signal PA4 is output. When the drive pulse signal PA4 is applied to the piezoelectric member 15, four drops of ink are ejected out from the nozzle 13*a* corresponding to the piezoelectric member 15.

The drive pulse signal PA3 is a signal obtained by removing the DRP waveform in the time range t0-t1 from the drive pulse signal (reference pulse signal) PA4. When a selection signal indicating the selection on three drops is input to the passing range selection circuits 232-1 to 232-*n*, the passing range selection circuits 232-1 to 232-*n* select the time range t1-t4 of the reference pulse signal as a passing range, as a result, the drive pulse signal PA3 is output. When the drive pulse signal PA3 is applied to the piezoelectric member 15, three drops of ink are ejected out from the nozzle 13*a* corresponding to the piezoelectric member 15.

The drive pulse signal PA2 is a signal obtained by removing the two DRP waveforms in the time range t0-t2 from the drive pulse signal (reference pulse signal) PA4. When a selection signal indicating the selection on two drops is input to the passing range selection circuits 232-1 to 232-*n*, the passing range selection circuits 232-1 to 232-*n* select the time range t2-t4 of the reference pulse signal as a passing interval, as a result, the drive pulse signal PA2 is output. When the drive pulse signal PA2 is applied to the piezoelectric member 15, two drops of ink are ejected out from the nozzle 13*a* corresponding to the piezoelectric member 15.

The drive pulse signal PA1 is a signal obtained by removing the three DRP waveforms in the time range t0-t3 from the drive pulse signal (reference pulse signal) PA4. When a selection signal indicating the selection on one drop is input to the passing range selection circuits 232-1 to 232-*n*, the passing range selection circuits 232-1 to 232-*n* select the interval t3-t4 of the reference pulse signal as a passing interval, as a result, the drive pulse signal PA1 is output. When the drive pulse signal PA1 is applied to the piezoelectric member 15, one drop of ink is ejected out from the nozzle 13*a* corresponding to the piezoelectric member 15.

Figure 6:
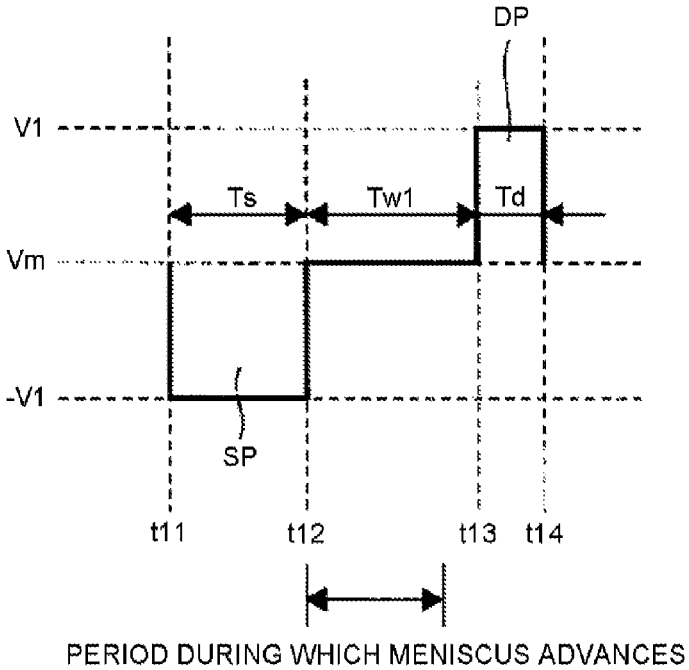
FIG. 6 is a diagram illustrating a DRP waveform.

FIG. 6 is a diagram illustrating a DRP waveform. As shown in FIG. 6, a DRP waveform includes an ejection pulse SP serving as a first pulse and a damping pulse DP serving as a second pulse. The ejection pulse SP is the pulse of a voltage −V1 changed to be lower than a reference voltage Vm, and the pulse width of the ejection pulse SP is set to Ts; the damping pulse DP, which is the pulse of a voltage changed to be higher than the reference voltage Vm and the pulse width of which is set to Td, is generated Tw1 later than the rising of the ejection pulse SP. The reference voltage Vm refers to the voltage applied to the piezoelectric member 15 corresponding to the nozzle 13*a* in a normal state in which no ink drop is ejected.

When applying the ejection pulse SP (negative voltage pulse-on), the voltage applied to the piezoelectric member 15 is changed from Vm to −V1. At the point of time t11 the ejection pulse SP falls, the piezoelectric member 15 contracts with respect to the normal state; with the contraction, the vibration plate 14 stuck fast to the piezoelectric member 15 is deformed, increasing the volume of the pressure chamber 11. As the volume of the pressure chamber 11 is increased, a negative pressure is generated instantly in the pressure chamber 11.

The expansion of the pressure chamber 11 lasts after the time Ts elapsed. The pulse width Ts of the ejection pulse SP is set to ½ of the natural vibration period of the pressure chamber 11. In this embodiment, the natural vibration period is 4.6 μs, and the pulse width Ts is 2.3 μm. During Ts, ink flows from the common liquid chamber 18 into the pressure chamber 11. Further, the meniscus on the front end of the nozzle 13*a* backs to the side of the pressure chamber 11. The pressure in the pressure chamber 11 changes from a negative pressure to a positive pressure.

When rising the ejection pulse SP (negative voltage pulse-off), the voltage applied to the piezoelectric member 15 is changed back to Vm from −V1. At the point of time t12 the ejection pulse SP rises, the piezoelectric member 15 recovers to normal. With the recovery, the internal volume of the pressure chamber 11 returns to normal. At this time, a positive pressure is generated instantly in the pressure chamber 11, and with the pressure, the meniscus in the nozzle 13*a* advances.

The meniscus advances till ½ of the natural vibration period elapses (e.g. 2.3 μs) from the moment the ejection pulse SP rises, meanwhile, the pressure in the pressure chamber 11 changes again from a positive pressure to a negative pressure. Then, ink drops are separated from the ink inside the nozzle and ejected out. Then, applying the damping pulse DP (positive voltage pulse-on), the voltage applied to the piezoelectric member 15 is changed from Vm to V1 at the point of time t13, the volume of the piezoelectric member 15 increases. With the expansion, the vibration plate 14 stuck fast to the piezoelectric member 15 is deformed to make the pressure chamber 11 contract. A positive pressure is generated instantly in the pressure chamber 11 as the volume of the pressure chamber 11 contracts.

The pressure chamber 11 contracts for a time of the pulse width Td (e.g. 0.9 us) of the damping pulse DP. Then, at the point of time t14 the voltage applied to the piezoelectric member 15 is changed back to Vm from V1 because of the falling of the damping pulse DP (positive voltage pulse-off), the piezoelectric member 15 recovers to normal. The turn-off of the positive voltage pulse makes the charging state of the piezoelectric member charged to V1 return back to Vm. With the recovery, the positive pressure in the pressure chamber 11 drops back to 0. Then, the residual vibration in the pressure chamber 11 is eliminated.

Figure 7:
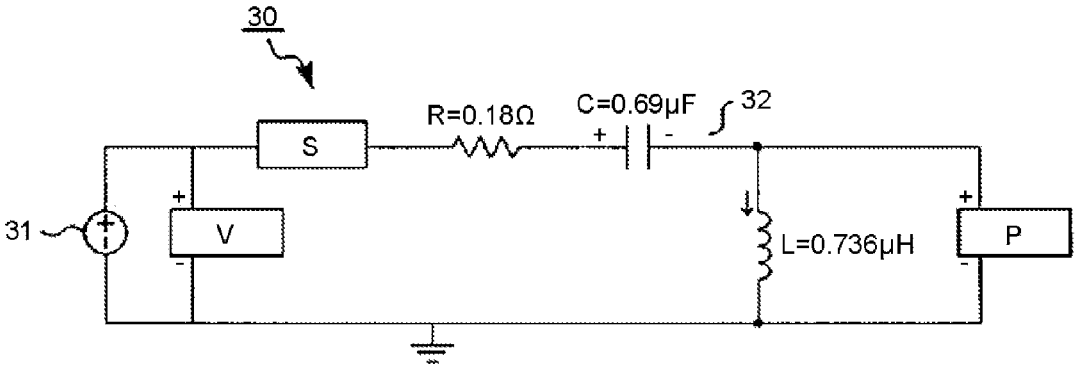
FIG. 7 is a diagram illustrating an equivalent circuit equivalent to the pressure chamber of an ink jet head.

Next, the output timing of the damping pulse DP is described using the equivalent circuit 30 shown in FIG. 7.

The equivalent circuit 30 is a circuit formed by connecting a series circuit (hereinafter referred to as an LCR circuit 32) consisting of a resistor R, a capacitor C and an inductor L with a voltage source 31. The resistance of the resistor R is 0.18Ω, the capacitance of the capacitor C is 0.69 uF, and the inductance of the inductor L is 0.736 uH. The equivalent circuit 30 represents the pressure chamber 11 of the ink jet head 1. The voltage generated at two terminals of the voltage source 31 is equivalent to the displacement of the actuator and can be deemed as a drive voltage applied to the actuator. The voltage generated at two terminals of the inductor L is equivalent to the pressure on the periphery of the nozzle 13*a* in the pressure chamber 11. On the periphery of the nozzle 13*a* in the pressure chamber 11, the circuit current is equivalent to the velocity of the ink flowing towards the nozzle. In the equivalent circuit 30, the voltage source 31 is connected with a voltmeter V in parallel; an ammeter (current meter) S is connected between the voltage source 31 and the resistor R, and the inductor L is connected with a voltmeter P in parallel. The flow velocity of the ink from the common liquid chamber 18 to the inlet of the pressure chamber 11 is reverse to that of the ink on the periphery of the nozzle 13*a*. For example, at the time t11 shown in FIG. 6, the pressure chamber 11 expands, the ink on the periphery of the nozzle 13*a* backs to the side of the pressure chamber 11 while an ink flow flowing from the common liquid chamber 18 to the pressure chamber 11 appears. The flow of the ink in this direction is equivalent to a value changing the value of the ammeter S to be negative.

Figure 8:
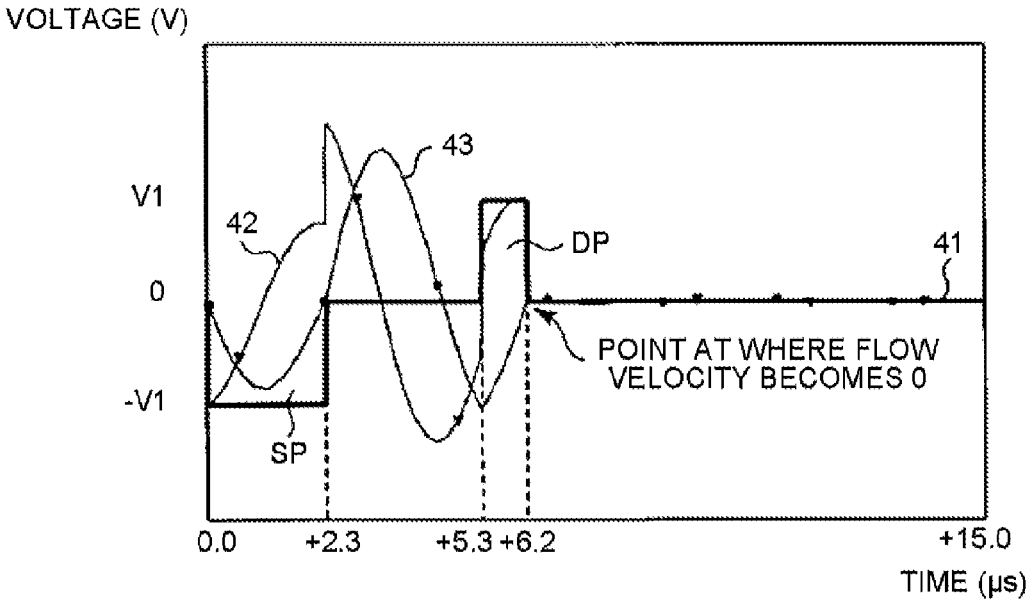
FIG. 8 is a timing chart illustrating the drive pulse waveform of a DRP waveform, and the waveforms of the pressure and the flow velocity in the pressure chamber.

A pulse signal 41 having the DRP waveform shown in FIG. 8 is applied from the voltage source 31 to the LCR circuit 32. In the pulse signal 41, the pulse width Ts of the ejection pulse SP is 2.3 μs, the pulse width of the damping pulse DP is 0.9 us, and the interval Tw1 between the ejection pulse SP and the damping pulse DP is 3.0 us. The waveform 42 shown in FIG. 8 represents the change of the voltage generated at two terminals of the inductor L when the pulse signal 41 is applied to the LCR circuit 32, that is, a pressure change; and the waveform 43 shown in FIG. 8 represents the circuit current change, that is, the flow velocity change.

At the point of time the 6.2 μs elapses from the point of time the ejection pulse SP falls (just before the damping pulse DP falls), the voltage (pressure) generated at two terminals of the inductor L becomes V1. The circuit current (flow velocity) becomes 0. The voltage (pressure) V1 is reverse in polarity to but equal in amplitude to the voltage (pressure) generated at two terminals of the inductor L at the point of time the ejection pulse SP falls. In this case, the voltage (pressure) generated at two terminals of the inductor L becomes 0 if the damping pulse DP falls at this point. In addition, the circuit current (flow velocity) becomes 0 as well. That is, the residual vibration of the pressure chamber 11 is eliminated.

The damping pulse DP should be raised at the time causing vibration of the voltage (pressure) generated at two terminals of the inductor L becomes V1 when the circuit current (flow velocity) becomes 0, which indeed eliminates the residual vibration of the pressure chamber 11. In other words, the residual vibration of the pressure chamber 11 cannot be eliminated if there is no point of time at which the voltage (pressure) generated at two terminals of the inductor L becomes V1 and the circuit current (flow velocity) becomes 0.

Figure 9:
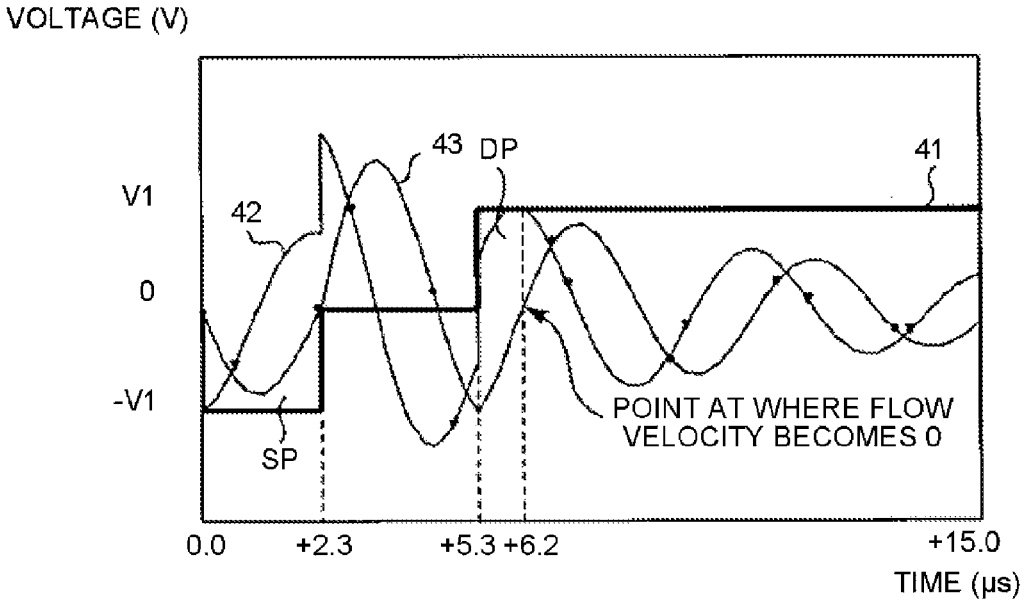
FIG. 9 is a timing chart illustrating the DRP waveform shown in FIG. 8 when a damping pulse is not turned off.

The amplitude of the voltage (pressure) generated at two terminals of the inductor L is changed by adjusting the time at which the damping pulse DP rises. In the case of the equivalent circuit 30, as shown in FIG. 9, if the damping pulse DP rises after 5.3 μs elapses from the point of time the ejection pulse SP falls, then, the voltage (pressure) generated at two terminals of the inductor L becomes V1 after 6.2 μs elapses, moreover, the circuit current (flow velocity) becomes 0. At this time, if the damping pulse DP falls (refer to FIG. 8), the residual vibration of the pressure chamber 11 is eliminated, as shown in FIG. 8.

Figure 10:
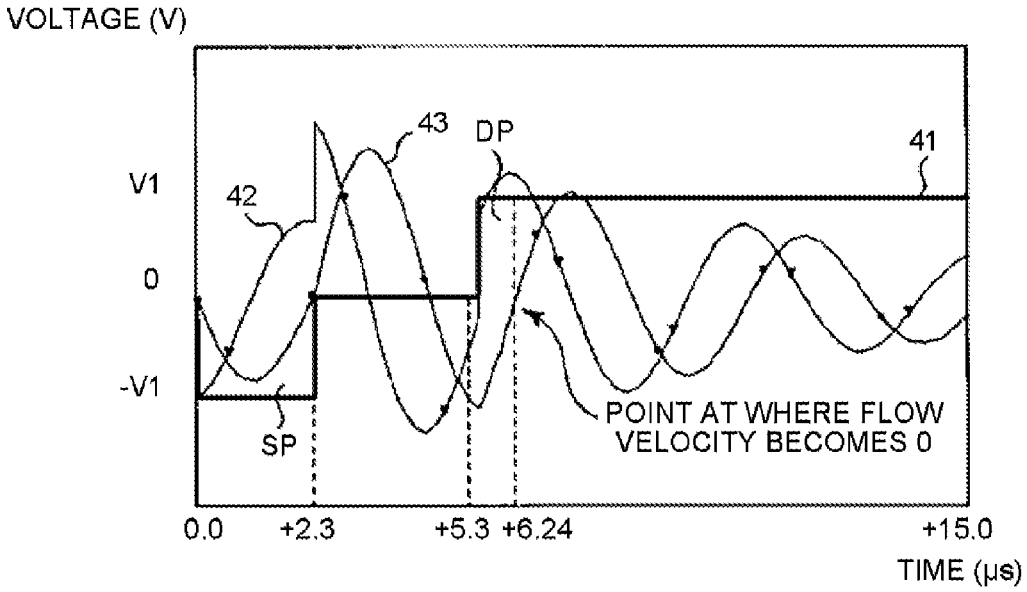
FIG. 10 is a timing chart illustrating the DRP waveform shown in FIG. 9 when the on-timing of a damping pulse is delayed.
Figure 11:
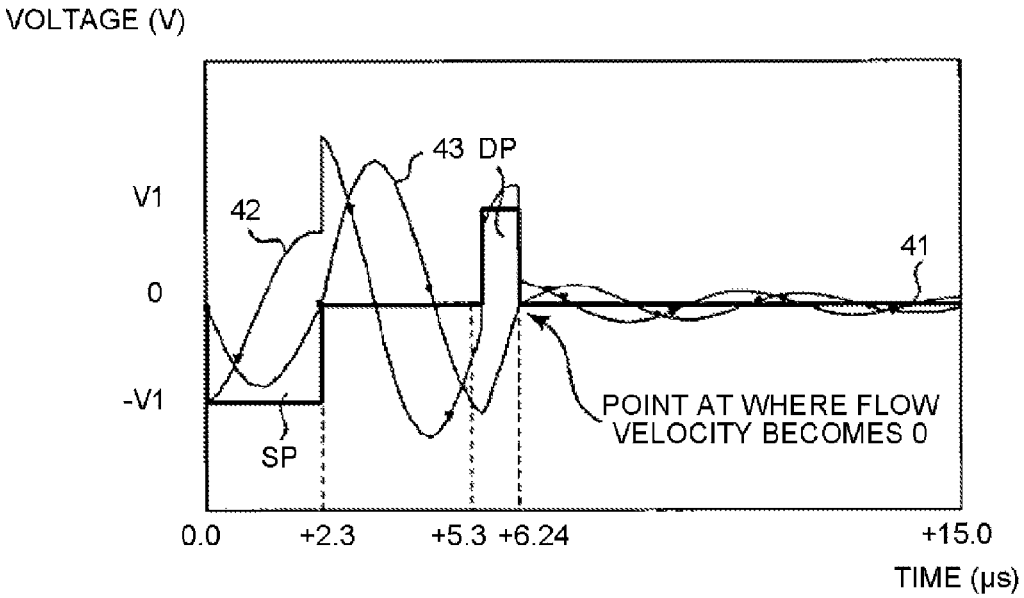
FIG. 11 is a timing chart illustrating the DRP waveform shown in FIG. 10 when a damping pulse is turned off.

FIG. 10 shows the rise of the damping pulse DP after more than 5.3 μs elapses from the point of time the ejection pulse SP falls. At this time, the voltage (pressure) generated at two terminals of the inductor L is greater than V1 at the point of time after 6.24 μs when the circuit current (flow velocity) becomes 0 elapses. Thus, as shown in FIG. 11, at the point of time the circuit current (flow velocity) becomes 0, the residual vibration of the pressure chamber 11 is still remained even if the damping pulse DP falls.

Figure 12:
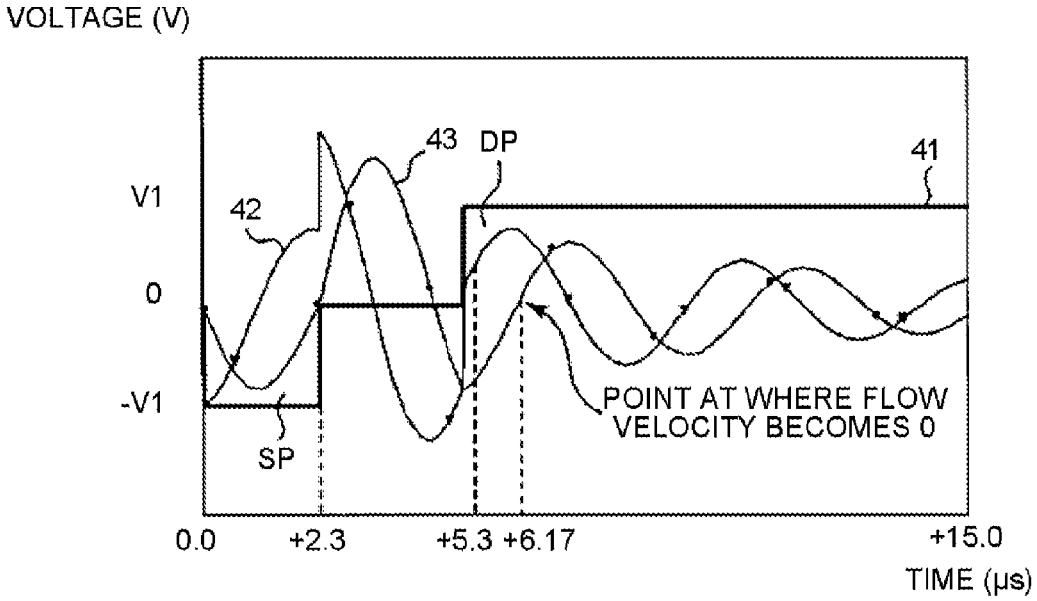
FIG. 12 is a timing chart illustrating the DRP waveform shown in FIG. 8 when the on-timing of a damping pulse is ahead of time and a damping pulse is not turned off.
Figure 13:
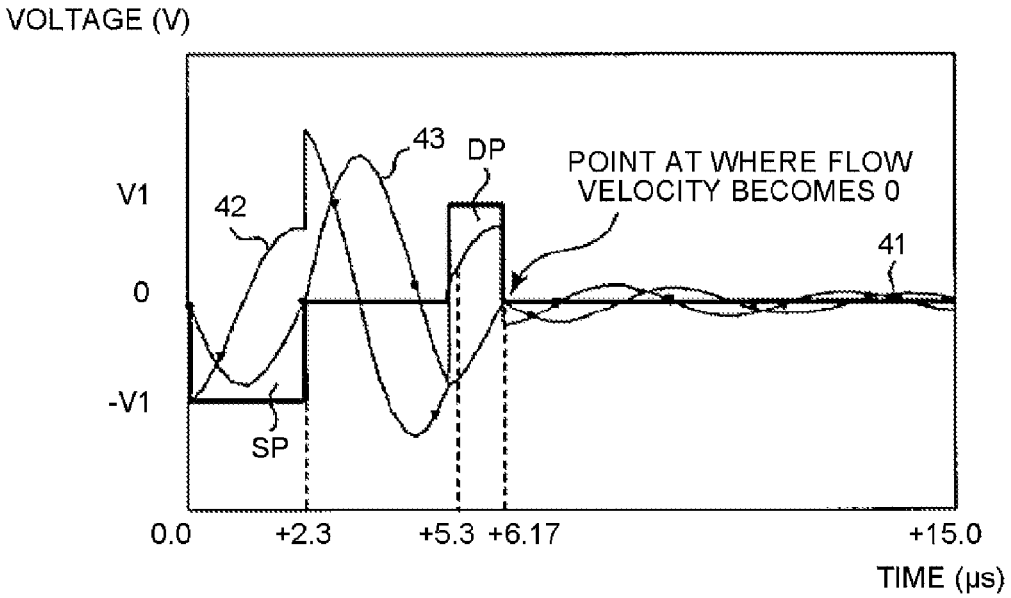
FIG. 13 is a timing chart illustrating the DRP waveform shown in FIG. 12 when a damping pulse is turned off.

FIG. 12 shows the rise of the damping pulse DP after less than 5.3 μs elapses from the point of time the ejection pulse SP falls. At this time, the voltage (pressure) generated at two terminals of the inductor L is smaller than V1 at the point of time after 6.17 μs when the circuit current (flow velocity) becomes 0 elapses. Thus, as shown in FIG. 13, at the point of time the circuit current (flow velocity) becomes 0, the residual vibration of the pressure chamber 13 is still remained even if the damping pulse DP falls.

The damping pulse DP is contained in the drive pulse signal to eliminate the residual vibration of the pressure chamber 11. As described above with reference to FIG. 10-FIG. 13, the residual vibration cannot be eliminated when the output timing of the damping pulse DP is deviated.

Thus, as to the damping pulse DP in a DRP waveform, as shown in FIG. 9, the damping pulse DP rises (positive voltage pulse-on) at the point of time the voltage (pressure) generated at two terminals of the inductor L becomes V1 and the circuit current (flow velocity) becomes 0 after the rise of the damping pulse DP. Then, as shown in FIG. 8, the damping pulse DP falls (positive voltage pulse-off) at the point of time the voltage (pressure) generated at two terminals of the inductor L becomes V1 and the circuit current (flow velocity) becomes 0. The reference drive waveform generation portion 231 generates a reference pulse signal having such a DRP waveform.

Figure 14:
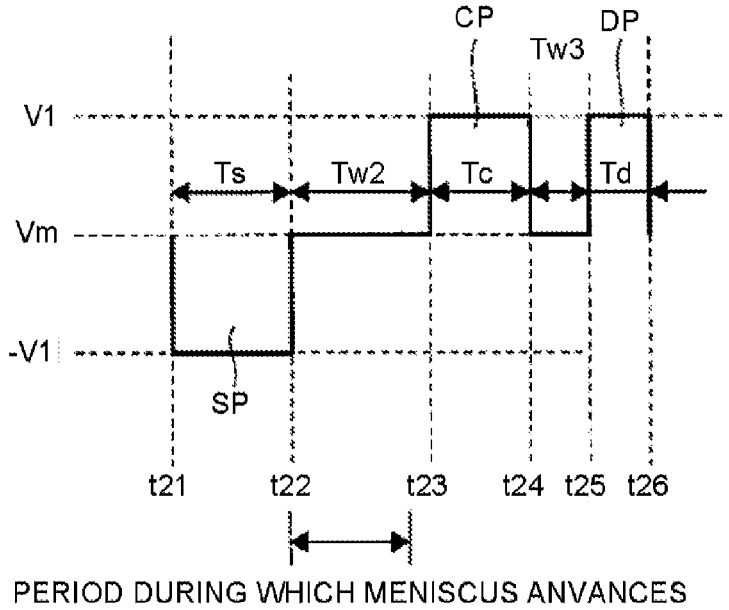
FIG. 14 is a diagram illustrating a DRCRP waveform.

FIG. 14 is a diagram illustrating a DRCRP waveform. As shown in FIG. 14, in a DRCRP waveform, there is a satellite canceling pulse CP serving as a third pulse between the ejection pulse SP and the damping pulse DP of a DRP waveform. The satellite canceling pulse CP is a pulse of the voltage V1 changed to be higher than the reference voltage Vm, and the pulse width of the satellite canceling pulse CP is set to Tc. The satellite canceling pulse CP is generated after Tw2 elapses from the rise of the ejection pulse SP. The damping pulse DP is generated after Tw3 elapses from the falling of the satellite canceling pulse CP.

The 'satellite' of the satellite canceling pulse CP refers to a satellite drop. An ink drop is usually ejected out from the nozzle 13*a*, leaving a trail. Then, when the ink drop is separated from the ink in the nozzle 13*a*, the trail part, that is, the called liquid column becomes a spherical satellite drop and flies following the main ink drop. The satellite drop flying at a lower speed is separated from the main liquid drop and impacts on a recording medium. Consequentially, printing quality is degraded due to the density unevenness and ghost caused by the satellite drop. The satellite canceling pulse CP is used to prevent the generation of a satellite drop.

During the period from t21 at which the ejection pulse SP drops to t22 at which the ejection pulse SP rises, the DRCRP waveform functions as a DRP waveform, that is, at the point of time t22 the voltage applied to the piezoelectric member 15 is changed back to Vm from −V1, the meniscus in the nozzle 13*a* starts to advance.

The meniscus advances till ½ of the natural vibration period elapses (e.g. 2.3 μs) from the point of time the ejection pulse SP rises, then, the ink liquid column is to be separated from the nozzle 13*a* after the time Tw2 (e.g. 3.25 us) elapses. At this time, the satellite canceling pulse CP rises (positive voltage pulse-on). The volume of the piezoelectric member 15 increases at the point of time t23 the voltage applied to the piezoelectric member 15 is changed from Vm to V1 due to the rise of the satellite canceling pulse CP. With the expansion, the vibration plate 14 stuck fast to the piezoelectric member 15 is deformed to make the pressure chamber 11 contract. A positive pressure is generated instantly in the pressure chamber 11 as the pressure chamber 11 contracts. With the pressure, the ink liquid column is pushed out from the pressure chamber 11. As a result, the liquid column and the ink drop are separated from the ink in the nozzle together and ejected out from the nozzle 13*a*. Thus, no satellite drop is generated.

The pressure chamber 11 keeps in a contracted state for a time equivalent to the pulse width Tc (e.g. 1.85 us) of the satellite canceling pulse CP. Tc is the time needed for the separation of the liquid column from the ink in the nozzle 13*a* and the following ejection of the whole separated liquid column out from the nozzle 13*a*. Then, the piezoelectric member 15 recovers to normal at the point of time t24 the voltage applied to the piezoelectric member 15 is changed back to Vm from V1 due to the falling of the satellite canceling pulse CP (positive voltage pulse-off). With the recovery, the internal volume of the pressure chamber 11 returns to normal and is kept in the normal state for Tw3 (e.g. 1.3 us). Then, the volume of the piezoelectric member 15 increases again at the point of time t25 the voltage applied to the piezoelectric member 15 is changed from Vm to V1 due to the rise of the damping pulse DP. With the expansion, the vibration plate 14 stuck fast to the piezoelectric member 15 is deformed to make the pressure chamber 11 contract. As the pressure chamber contracts, a positive pressure is generated instantly in the pressure chamber 11.

The pressure chamber 11 is kept in the contracted state for a time equivalent to the pulse width Td (e.g. 0.95 us) of the damping pulse DP, then, the piezoelectric member 15 recovers to normal again at the point of time t26 the voltage applied to the piezoelectric member 15 is changed back to Vm from V1 due to the falling of the damping pulse DP. With the recovery, the positive pressure in the pressure chamber 11 is changed to 0. Then, the residual vibration in the pressure chamber 11 is eliminated.

Next, the output timing of the satellite canceling pulse CP is described with reference to the equivalent circuit 30 shown in FIG. 7.

Figure 15:
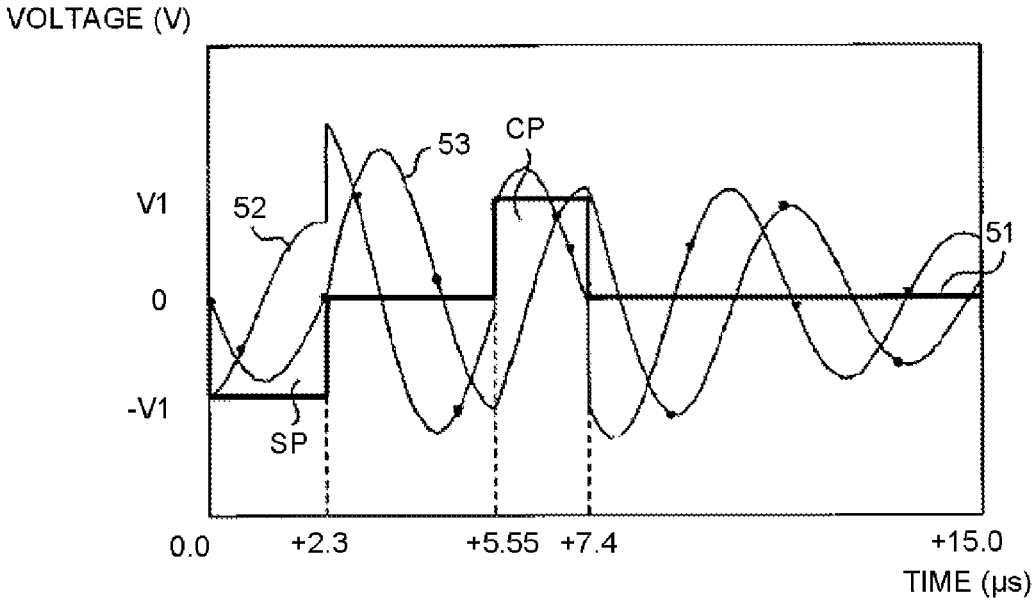
FIG. 15 is a timing chart illustrating the drive pulse waveform of a DRCRP waveform when a damping pulse is omitted, and the waveforms of the pressure and the flow velocity in the pressure chamber.

A pulse signal 51 having the DRC waveform shown in FIG. 15 is applied from the voltage source 31 to the LCR circuit 30. Additionally, the DRC waveform is a waveform obtained by removing the damping pulse DP serving as the second pulse from a DRCRP waveform. In the pulse signal 51, the pulse width Ts of the ejection pulse SP is 2.3 μs, the pulse width of the satellite canceling pulse CP is 1.85 us, and the interval Tw1 between the ejection pulse SP and the satellite canceling pulse CP is 3.25 us. The waveform 52 shown in FIG. 15 represents the change of the voltage generated at two terminals of the inductor L when the pulse signal 51 is applied to the LCR circuit 32, that is, a pressure change; and the waveform 53 shown in FIG. 15 represents the circuit current, that is, the flow velocity change.

At the point of time 5.55 μs elapses from the moment the ejection pulse SP falls, the ink drop is to be separated from the nozzle 13*a*. At this time, the voltage (pressure) generated at two terminals of the inductor L is approximate to '0'. Here, the satellite canceling pulse CP rises, which reduces the volume of the pressure chamber 11 to push out the ink liquid column. Then, at the point of time 7.4 μs elapses from the moment the ejection pulse SP falls, the liquid column is ejected out from the nozzle 13*a*. At this time, the voltage (pressure) generated at two terminals of the inductor L is approximate to '0' again. Here, if the satellite canceling pulse falls, then the internal volume of the pressure chamber 11 returns to normal, the pressure in the pressure chamber 11 drops sharply, making the ink which is not ejected out but left nearby the nozzle return back into the pressure chamber. In this way, the liquid column is separated from the ink in the nozzle, thereby inhibiting the generation of a satellite drop.

Figure 16:
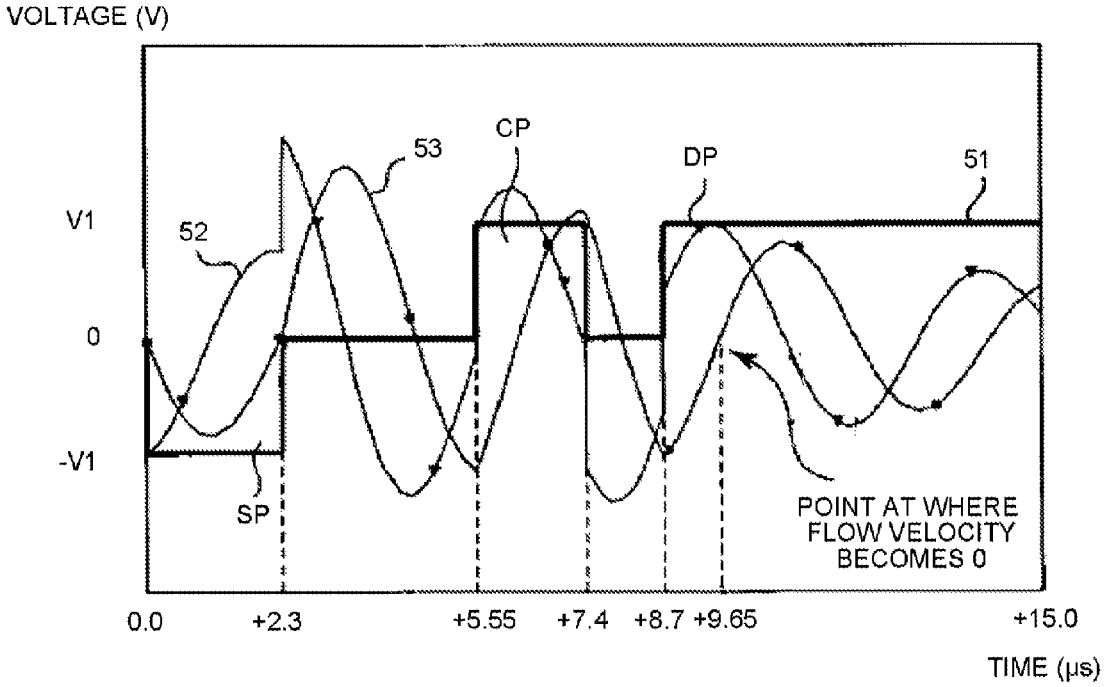
FIG. 16 is a timing chart illustrating the drive pulse waveform of a DRCRP waveform when a damping pulse is turned on, and the waveforms of the pressure and the flow velocity in the pressure chamber.
Figure 17:
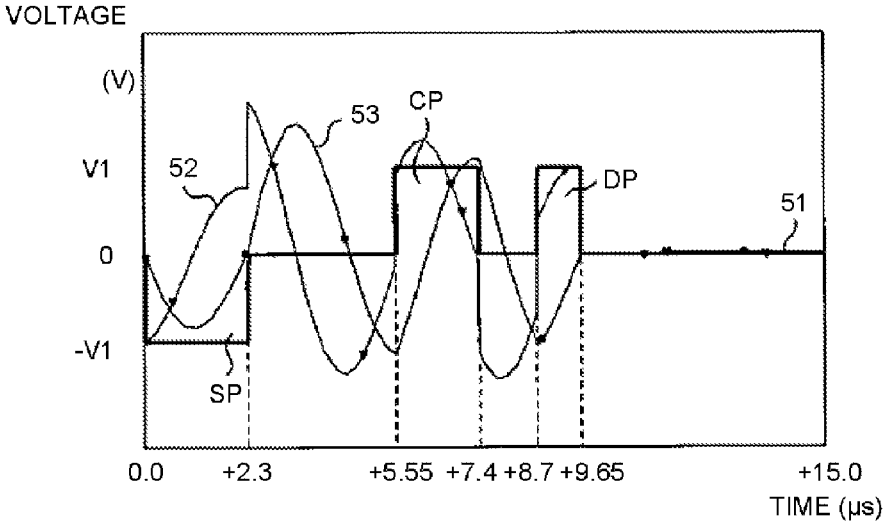
FIG. 17 is a timing chart illustrating the drive pulse waveform of a DRCRP waveform shown in FIG. 15 when a damping pulse is turned off, and the waveforms of the pressure and the flow velocity in the pressure chamber.

However, as shown in FIG. 15, the vibration of the pressure chamber in the DRC waveform cannot be eliminated. Thus, if a DRC waveform is continuously supplied to eject ink, the ejection becomes unstable. So, as shown in FIG. 16, after the satellite canceling pulse CP falls, a damping pulse DP is supplied to eliminate pressure vibration. The damping pulse DP rises at the time causing pressure vibration of the voltage (pressure) generated at two terminals of the inductor L becomes V1 when the circuit current (flow velocity) becomes 0, and then falls when the voltage (pressure) generated at two terminals of the inductor L becomes V1 and circuit current (flow velocity) becomes 0, as shown in FIG. 17. By applying a drive pulse signal having such a DRCRP waveform to the ink jet head 1, the generation of a satellite drop is prevented while the residual vibration of the pressure chamber 11 is eliminated.

Though DRCRP waveform eliminates both the satellite drop and the residual vibration as mentioned above, it takes longer time for one drive pulse train of the waveform compared with the DRC or DRP waveform.

Especially in a case where a multi-drop manner which includes multiple pulse trains of waveforms for sub drops in a dot, using DRCRP waveform for every sub drop takes longer waveform time and degrades the print speed. But in this case, DRCRP waveform is necessary only at the last waveform for the last sub drop in the multiple drops with the following reason.

It's because, in the case of the multi-drop manner, generated satellites at any time prior to the last ink sub drop will be gathered with the following liquid drop and never reaches on the printing medium alone, which causes no deterioration of the print quality.

In this embodiment, as shown in FIG. 5, a DRCRP waveform is used only when the last sub drop is ejected, and before this, DRP waveform is used. Thus, this embodiment achieves high-speed printing while eliminating problems caused by the satellite drop and the residual vibration.

Further, in this embodiment, as shown in FIG. 5, each waveforms for sub drops are filled with backward (later time) justified manner, which means the timing of the waveform for the last drop is common regardless of the gradation (the number of drops). The time of the DRCRP waveform in the time range t3-t4 of the drive pulse signal is common in each actuator as a base timing. Then, DRP waveforms are added prior to the DRCRP waveform if the number of ink drops is more than 1.

Because of using the backward justified manner for placing each waveform for each sub drop, the waveform PA4 including 3 DRP waveforms prior to 1 DRCRP waveform can be used as a reference drive waveform.

Thus, the reference drive waveform generation portion 231 of the drive signal generation section 23 shown in FIG. 4 generates the waveform of PA4 as a reference drive waveform which is common to each actuator, simplifying the structure of the drive signal generation section 23.

Further, the present invention is not limited to the embodiments above.

For example, the aforementioned embodiments are described as a drive apparatus and a drive method for the ink jet head 1 having the structure shown in FIG. 1-FIG. 3, however, the embodiments may be applied to an ink jet head with another structure, for example, the embodiments may be applied to an ink jet head for driving each nozzle in a time division manner.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A drive method for an ink jet head, comprising:

as a drive pulse, applying a first pulse for increasing and then restoring the volume of a pressure chamber and giving pressure vibration to the chamber in which ink are accommodated, and then a second pulse for reducing and then restoring the volume of the pressure chamber to an actuator arranged corresponding to the pressure chamber wherein the second pulse is turned on at first point of time causing the pressure vibration amplitude at second point of time to be the same with that of generated by the first pulse when the first pulse is turned on, wherein the second point of time is the time when flow velocity of the ink nearby the nozzle inside the pressure chamber becomes 0 after the first point of time, and the second pulse is turned off at the second point of time.

2. The drive method for an ink jet head according to claim 1, wherein a third pulse is applied between the first pulse and the second pulse as the drive pulse to reduce and then restore the volume of the pressure chamber.

3. The drive method for an ink jet head according to claim 2, wherein the third pulse is turned on when the pressure of the pressure chamber becomes 0 and turned off when the pressure of the pressure chamber becomes 0 again.

4. The drive method for an ink jet head according to claim 2, wherein the third pulse is turned on when an ink liquid column is to be separated from the nozzle and turned off when the ink liquid column is completely separated from the nozzle later.

5. A drive apparatus for an ink jet head which ejects ink drops out from a nozzle connected with a pressure chamber, comprising:

a drive signal generation section configured to apply, as a drive pulse, a first pulse for increasing and then restoring the volume of the pressure chamber and giving pressure vibration to the chamber in which ink are accommodated, and then a second pulse for reducing and then restoring the volume of the pressure chamber to an actuator arranged corresponding to the pressure chamber, wherein the drive signal generation section turns on the second pulse at first point of time causing the pressure vibration amplitude at second point of time to be the same with that of generated by the first pulse when the first pulse is turned on, wherein the second point of time is the time when flow velocity of the ink nearby the nozzle inside the pressure chamber becomes 0 after the first point of time, and turns off the second pulse at the second point of time.

6. The drive apparatus for an ink jet head according to claim 5, wherein the drive signal generation section applies a third pulse between the first pulse and the second pulse as the drive pulse to reduce and then restore the volume of the pressure chamber.

7. The drive apparatus for an ink jet head according to claim 6, wherein the drive signal generation section turns on the third pulse when the pressure of the pressure chamber becomes 0 and turns off the third pulse when the pressure of the pressure chamber becomes 0 again.

8. The drive apparatus for an ink jet head according to claim 6, wherein the drive signal generation section turns on the third pulse when an ink liquid column is to be separated from the nozzle and turns off the third pulse when the ink liquid column is completely separated from the nozzle later.

9. A drive apparatus for an ink jet head which ejects ink drops out from a nozzle connected with a pressure chamber, comprising:

a drive signal generation section configured to apply, as a drive pulse, a first pulse for increasing and then restoring the volume of a pressure chamber and giving pressure vibration to the chamber in which ink are accommodated;

a second pulse for reducing and then restoring the volume of the pressure chamber cancelling the pressure vibration of a pressure chamber; and a third pulse for reducing and then restoring the volume of the pressure chamber, to an actuator arranged corresponding to the pressure chamber, wherein when carrying out a gradation printing by changing a number of the ink drops ejected out from the nozzle of the ink jet head according to a number of drive pulses, the drive pulse includes a DRP waveform and a DRCRP waveform, the DRP waveform being formed by orderly combining the first pulse and the second pulse, the DRCRP waveform being formed by orderly combining the first pulse, the third pulse, and the second pulse by applying the third pulse for reducing and then restoring the volume of the pressure chamber, between the first pulse and the second pulse, and the drive pulse for the ejection of the last ink drop is the DRCRP waveform.

10. The drive apparatus for an ink jet head according to claim 9, wherein the waveform for the ejection of an ink drop prior to the last ink drop is the first waveform.

11. The drive method for an ink jet head according to claim 9, wherein the waveform for the ejection of the last ink drop is applied at predetermined base timing, and waveform(s) are additionally applied prior to the base timing if the number of ink drops is more than 1.

12. The drive apparatus for an ink jet head according to claim 9, wherein the drive signal generation section comprises a reference drive waveform generation portion configured to generate a waveform for the formation of pixels of a maximum gradation including the first waveform and the second waveform; and passing range selection circuits configured to select a passing range for the waveform generated by the reference drive waveform generation section according to the number of the ink drops ejected out from the nozzle.

* * * * *